US008333684B2

(12) United States Patent
Colla

(10) Patent No.: US 8,333,684 B2
(45) Date of Patent: Dec. 18, 2012

(54) PACKAGING BAG

(75) Inventor: Tiziano Colla, Dino (CH)

(73) Assignee: Water Line SA, Mezzovico (CH)

( * ) Notice: Subject to any disclaimer, the term of this patent is extended or adjusted under 35 U.S.C. 154(b) by 471 days.

(21) Appl. No.: 12/501,804

(22) Filed: Jul. 13, 2009

(65) Prior Publication Data

US 2010/0014790 A1 Jan. 21, 2010

(30) Foreign Application Priority Data

Jul. 15, 2008 (CH) ..... 1099/08

(51) Int. Cl.
*B65D 30/20* (2006.01)
*B31B 1/00* (2006.01)

(52) U.S. Cl. ..... 493/210; 493/223; 493/383

(58) Field of Classification Search ..... 493/210, 493/212, 223, 383
See application file for complete search history.

(56) References Cited

U.S. PATENT DOCUMENTS

| | | | | |
|---|---|---|---|---|
| 5,275,491 | A * | 1/1994 | Kuge et al. | 383/61.2 |
| 5,364,189 | A * | 11/1994 | Kuge et al. | 383/61.2 |
| 2002/0147090 | A1* | 10/2002 | Kuge et al. | 493/162 |
| 2008/0205801 | A1* | 8/2008 | Alaux | 383/120 |
| 2009/0175565 | A1* | 7/2009 | Totani | 383/120 |
| 2010/0183249 | A1* | 7/2010 | Wedi et al. | 383/120 |

FOREIGN PATENT DOCUMENTS

| | | | |
|---|---|---|---|
| DE | 10 2005 057 669 | A1 | 6/2007 |
| JP | 07-100972 | A | 4/1995 |
| JP | 2007-22570 | A | 2/2007 |

* cited by examiner

*Primary Examiner* — Hemant M Desai
(74) *Attorney, Agent, or Firm* — The Webb Law Firm

(57) ABSTRACT

The invention discloses a method of producing a packaging bag from a multilayered sheet material which can be welded on one side, wherein the packaging bag comprises a front wall, a rear wall, a right-hand side gusset, a left-hand side gusset, a bottom and a head portion, which is located opposite the bottom and has an opening which can be closed by a closure element. The two side gussets, the front wall and the rear wall are of essentially the same length and are welded to one another and therefore, other than in the head portion, the side gussets are connected to the front wall and the rear wall over their entire length. The weldable surface is directed towards the interior of the packaging bag.

10 Claims, 15 Drawing Sheets

PACKAGING BAG

TECHNICAL FIELD OF THE INVENTION

The present invention relates to a method of producing a packaging bag, in particular a folding bag and to a packaging bag.

PRIOR ART

The prior art discloses packaging bags, in particular folding bags and side-gusset bags, and methods of producing such bags.

Such side-gusset bags typically comprise a front wall, a rear wall, a right-hand side gusset, a left-hand side gusset, a bottom and an opening, which is located opposite the bottom and is closed by a closure element. The bag can be filled through the opening and the contents can be removed from the bag, through the opening, by a user. A closure element arranged in the region of the opening closes the bag. This closure element may be designed, for example, as a reclosable closure element. The side walls here connect the front wall and the rear wall, usually by means of a weld connection.

Such bags are typically produced from a polyethylene or polypropylene sheet material (PE, PP). Such sheet material can be welded or sealed on one side, while the other side has printing on it and, not least as a result of this, cannot be welded. The printed side is located on the outside, in which case the user of a bag can glean packaging information from the printed side. Accordingly, the weldable surface is directed towards the interior. This property of the sheet material gives rise to problems in producing a bag since the individual elements have to be arranged in relation to one another such that always two weldable surfaces are located opposite one another, in order that an appropriate connection can be made. For example, it is difficult for the bag termination in the region of the opening to be produced satisfactorily and efficiently.

The prior art discloses, for example, the practice where parts of the side gussets are folded outwards in the region of the opening, and they are therefore no longer covered over by the front wall and the rear wall. The parts are then cut away, and the front wall is welded to the rear wall in this region. Although the folding operation can take place mechanically, it involves high outlay and is unreliable.

The disadvantage with the prior-art bags is the fact that these bags can gape in the region of the opening during filling and/or removal of the bag contents, in which case for example the connection of the two side gussets in this region becomes detached. This is due to the fact that the connecting locations in this region of the opening are inadequate in respect of this mechanical action to which they are subjected. The function of the reclosable closure element is thus impaired since, in the region of the opening, the front wall and the rear wall are spaced apart too far and the closure element may thus rupture. Defined and reliable closure is then no longer possible.

DESCRIPTION OF THE INVENTION

Taking this prior art as the departure point, the object of the invention is to provide a method and a bag which overcome the disadvantages of the prior art. In particular the bag produced is to be one which is designed in the region of the opening such that gaping or rupturing is no longer possible, and, in addition, the cross-section of the opening should not be impaired.

This object is achieved by a method having the features of claim 1. A method of producing a packaging bag from a multilayered sheet material which can be welded on one side is disclosed accordingly, wherein the packaging bag comprises a front wall, a rear wall, a right-hand side gusset, a left-hand side gusset, a bottom and a head portion, which is located opposite the bottom and has an opening which can be closed by a closure element. The two side gussets, the front wall and the rear wall are of essentially the same length and are welded to one another and therefore, other than in the head portion, the side gussets are connected to the front wall and the rear wall over their entire length. With other words: there is no connection due to the welding step between the side walls and the front wall or the back wall in the region of the head portion. The weldable surface is directed towards the interior of the packaging bag. According to the method, the front wall and/or the rear wall are/is swung away from the surface of the respective wall in the head portion. Then cutoff regions of the side gussets are removed. Following removal of the cutoff regions, the respective wall is pivoted back into the original position and a welding operation is executed in order to connect the front wall and the rear wall partially to one another in the head portion. In particular the front wall is connected to the rear wall in the cutoff region.

Connecting the front wall to the rear wall in the cutoff region in the head portion makes a connection which prevents gaping between the front wall and rear wall.

The cutoff region preferably extends from an end side, in the direction of the respective side gusset, along the outer edge of the side gusset.

The length of the cutoff region in the direction of the side gusset is preferably greater than the width of the cutoff region in the direction running transversely to the direction of the side gusset.

Prior to the welding operation, a closure element is preferably placed in position, and this is welded to the rear wall and the side gusset.

The weld connection between the front wall and the rear wall is preferably formed directly in the cutoff region and is formed indirectly, via the respective side gusset and the closure element, in the remaining regions. The direct connection in the cutoff region has the advantage that the front wall and the rear wall are connected to one another without any additional elements being required, and this provides a particularly good and mechanically strong connection which prevents gaping.

The cutoff region preferably runs transversely, or at an angle, to the direction of the respective side gusset and extends over the entire width of the respective side gusset, in which case the side gusset is shortened in length and a cutoff edge is produced.

Following the cutting operation, an enveloping element is preferably connected to the side gusset, wherein the enveloping element encloses the cutoff edge of the cutoff region, and wherein the enveloping element is welded to the side gusset on the top side of the side gusset and on the underside of the side gusset. Providing an enveloping element can give rise to a connection which is strong enough to prevent gaping and, in addition, the enveloping element has the advantage of improving sealing of the interior.

The weld connection between the front wall and the rear wall is preferably formed indirectly via the respective side gusset and the closure element and the enveloping element and/or directly in the region of an interspace.

Advantageous configurations of the method are disclosed in the dependent claims.

A packaging bag made up of a multilayered sheet material which can be welded on one side comprises a front wall, a rear wall, a right-hand side gusset, a left-hand side gusset, a bottom and a head portion which is located opposite the bottom and has an opening which can be closed by a closure element. The two side gussets, the front wall and the rear wall are of essentially the same length and are welded to one another and therefore, other than in the head portion, the side gussets are connected to the front wall and rear wall over their entire length. The weldable surface is directed towards the interior of the packaging bag. The side gussets have cutoff regions. The front wall and the rear wall are welded to one another in the cutoff region.

Advantageous configurations of this arrangement are disclosed in the dependent claims.

BRIEF DESCRIPTION OF THE DRAWING

Preferred embodiments will be described in more detail hereinbelow, by way of example, with reference to the drawing, in which.

DESCRIPTION OF PREFERRED EXEMPLARY EMBODIMENTS

Possible exemplary embodiments will be described in respect of the drawings. The drawings and the description disclose preferred exemplary embodiments and should not be interpreted as limiting the invention which is defined by the claims.

Figure 1:
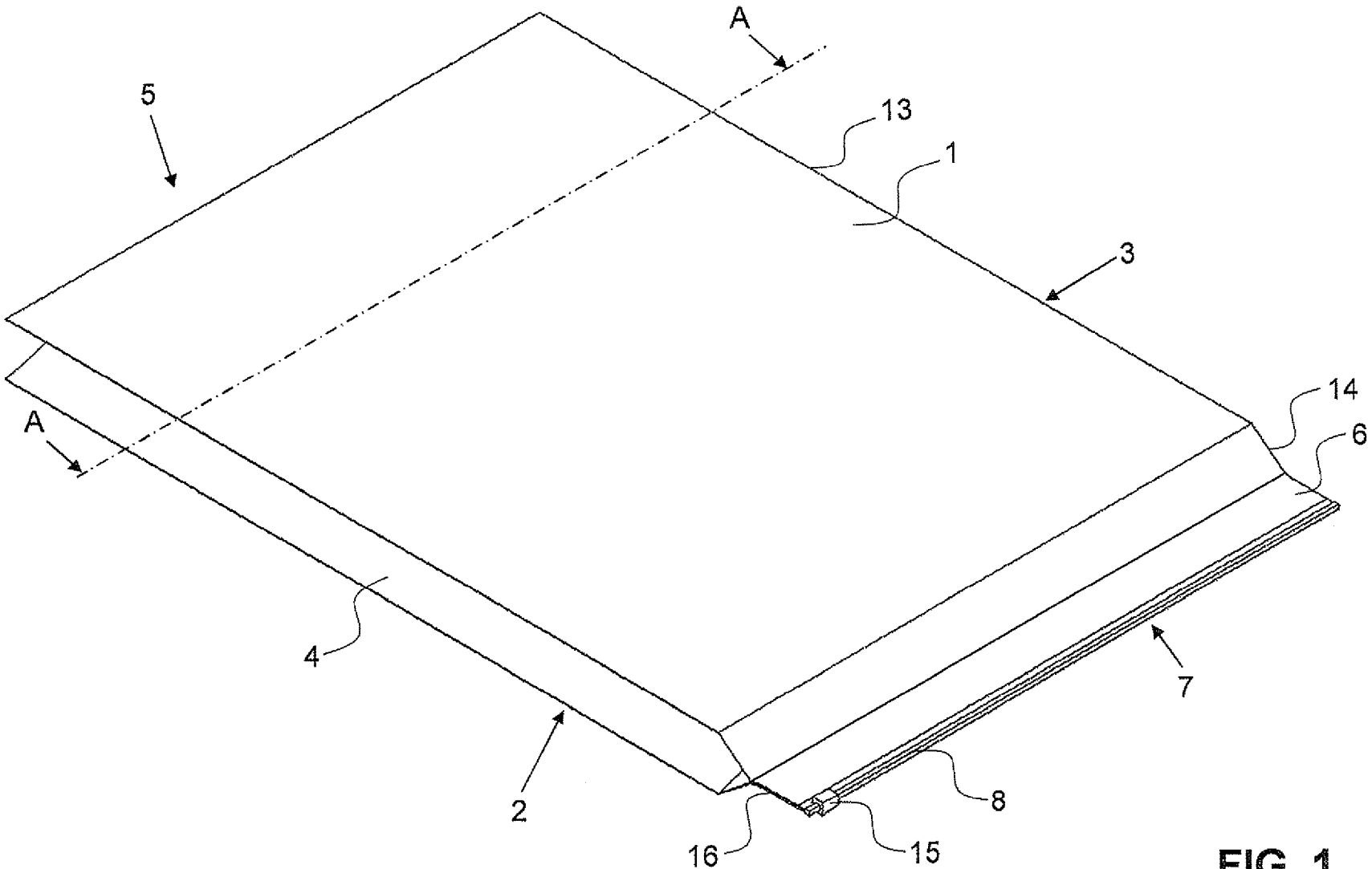
FIG. 1 shows a plan view of a filled bag according to a first embodiment of the present invention.

FIG. 1 then, which shows a filled bag according to the present invention, will be used to explain the structure of the bag. The bag comprises a front wall 1, a rear wall 2, a right-hand side gusset 3, a left-hand side gusset 4, a bottom 5 and a head portion 6, which is located opposite the bottom 5 and has an opening 7. As seen from the opening 7, the left-hand side gusset 4 connects the front wall 1 to the rear wall 2 on the left-hand side and the right-hand side gusset connects the front wall 1 to the rear wall 2 on the right-hand side. The side gussets 3, 4 here are connected to the front wall 1 and the rear wall 2 via weld connections.

The front wall 1, the rear wall 2, the two side gussets 3, 4 and the bottom 5 here bound the interior of the bag. Via the opening 7, the interior of the bag can be filled with the appropriate filling and the filling can be removed from the bag, in turn, via the opening 7. In addition, a closure element 8 is arranged in the region of the opening 7. The closure element 8 is preferably a reclosable closure element and may also comprise a tamper-evident element. A closure element 8 with a zipper or slider 15 is shown here.

Figure 2:
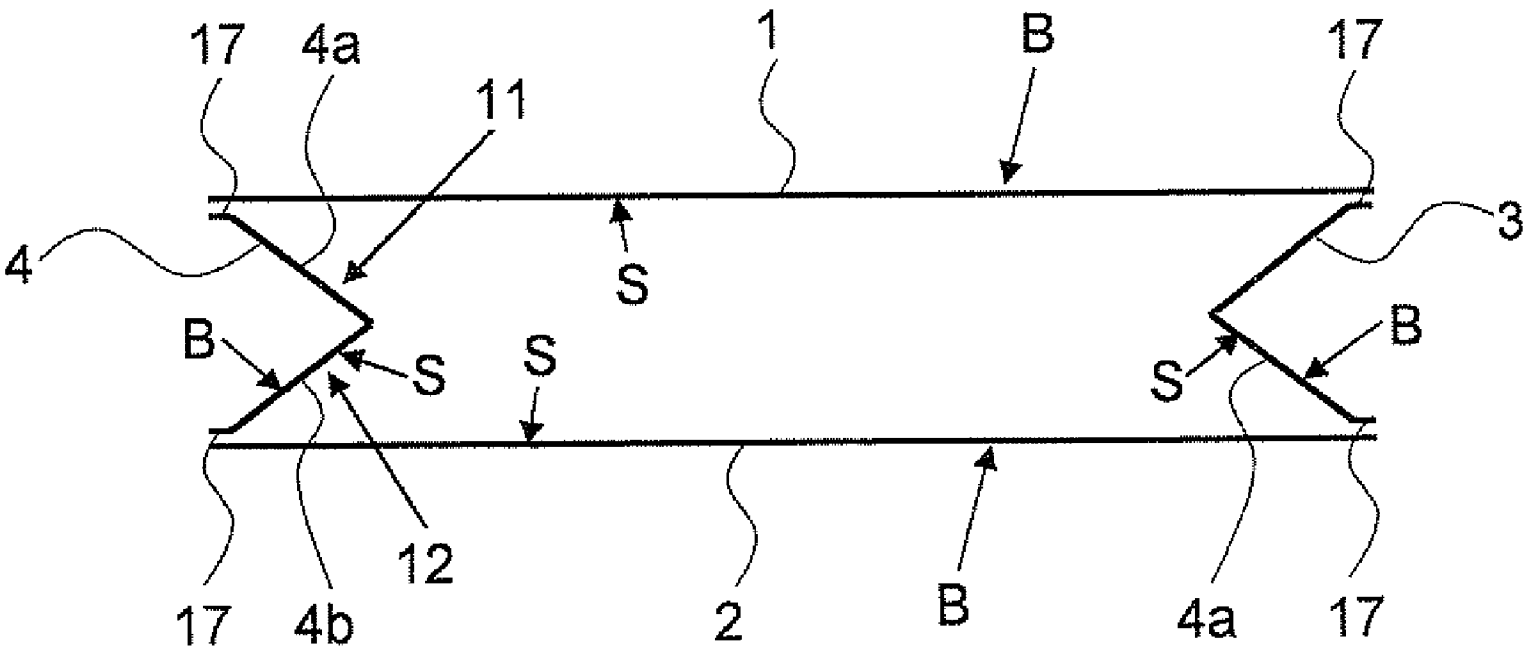
FIG. 2 shows a cross-section through the bag according to FIG. 1 along section line A-A.
Figure 3:
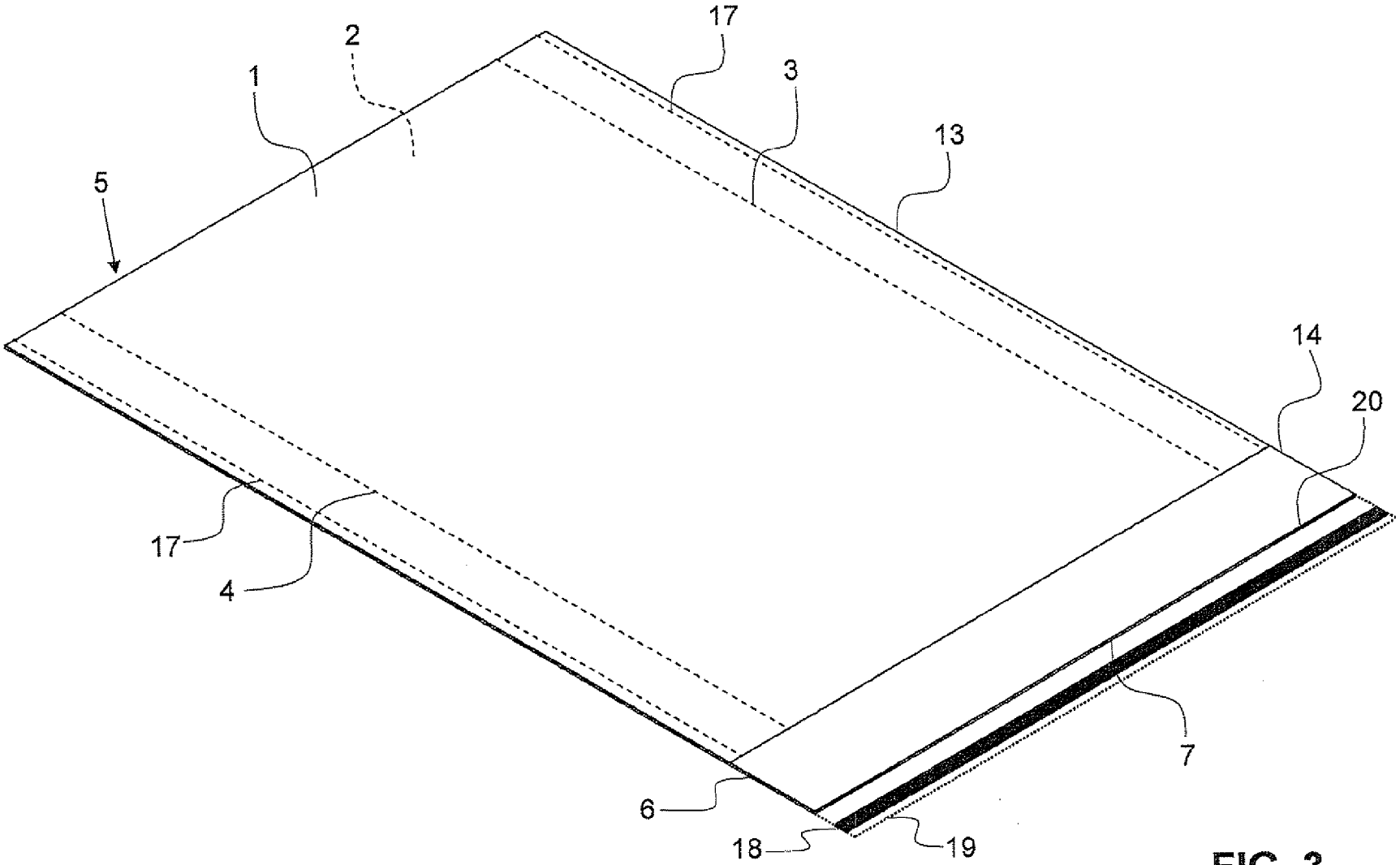
FIGS. 3 to 8 show a non-filled bag according to FIG. 1 in different steps of its production.

FIG. 2 shows the cross-section of a bag. As seen in cross-section, the side gussets 3, 4 are of v-shaped design. Accordingly, the side gussets 3, 4 extend from the location of connection to the front wall 1 in to the interior of the bag 1 along a first portion 3*a*, 4*a*. In the interior, the side gusset 3, 4 is deflected and extends outwards from the interior as a second portion 3*b*, 4*b*, towards the location of connection to the rear wall 2. That surface of the respective first portion 3*a*, 4*a* which extends in the direction of the interior, and is weldable, may also be referred to as the top side 11 of the side gusset. That surface of the respective second portion 3*b*, 4*b* which extends in the direction of the interior, and is weldable, may also be referred to as the underside 12 of the side gusset. As an alternative, the side gussets 3, 4 may also be designed in a c-shaped manner or in the form of bellows with a number of folds. The important factor is for there to be at least one fold which projects into the interior of the bag, in order to allow the bag to change over from a flat state, in which the front wall 1 and the rear wall 2 are more or less in contact, into an expanded state.

The welding capability of the bag will be explained with the aid of the schematic cross-section of FIG. 2. The bag here is produced from a sheet material of which one surface is weldable and the other surface has printing on it and cannot be welded. The weldable surface is designated S and the printed surface is designated B. In the case of two sheet-material parts being welded, the parts can be welded to one another via the respective weldable surfaces. In the case of the bag described here, the front wall 1, the rear wall 2 and the two side gussets 3, 4 are arranged such that the weldable surface S is directed towards the interior. Accordingly, the printed surface B is directed outward. FIG. 2 also shows the weld locations 17 which connect the side gussets 3, 4 to the walls 1, 2. Use can be made, for example, of a polyethylene sheet material. Such a sheet material may comprise a plurality of layers, for example a carrier layer (e.g. made of PET or PA), which is connected on one side to a weldable polyethylene sheet material. As an alternative, it is also possible for the weldable sheet material used to be a polypropylene sheet material. The weldable surface may also be referred to as a sealing surface.

Since only one surface of the sheet material is weldable, in each case two weldable surfaces have to be located opposite one another. A welding tool heats the region which it covers. After a certain period of being subjected to this, the weldable surfaces S in this region change over into a semi-liquid or liquid state, and the two surfaces are connected to one another.

The bottom 5 may be designed in various ways. Appropriate designs are known to a person skilled in the art.

As seen in the direction of the side gussets 3, 4, the bag is subdivided into different portions. A bag portion 13 essentially forms the interior. In this portion, the front wall 1 and the rear wall 2 run essentially parallel to one another.

A transition portion 14, which adjoins the bag portion 13, forms the transition to the opening 7 and/or to the head portion 6. In this transition portion 14, the front wall 1 and the rear wall 2 run at an angle to one another when the interior is filled, in which case the distance between the two walls 1, 2 decreases continuously in the direction of the opening 7. The distance between the two walls 1, 2 decreases here to the extent where the two walls 1, 2, towards the end of the transition portion 14, are spaced apart from one another by a distance which corresponds essentially to the thickness of the closure element 8.

The transition portion 14 is adjoined by the head portion 6, in which the front wall 1 and the rear wall 2, once again, run essentially parallel to one another. The closure element 8 and parts of the side gussets 3, 4 are located between the walls 1, 2, as will be described hereinbelow. The arrangement and design of a head portion 6, as will be explained in more detail hereinbelow, prevents the bag from gaping. Gaping of the bag is understood here to mean, in particular, the separation of the front wall 1 from the rear wall 2 in the region of the transition from the transition portion 14 to the head portion 6 and also in the head portion 6. This region is designated 16 (see FIG. 1). Such gaping is disadvantageous since the closure element can then easily burst open accidentally and the contents of the bag can escape. This is the case, in particular, when the entire head portion 6 gapes, that is to say when the front wall 1 in the region of the closure element 8 no longer runs parallel to the rear wall 2.

FIGS. 3 to 8 will now be used to explain a method of producing a bag according to FIG. 1. All these figures show a non-filled bag, with the front wall 1 resting essentially on the rear wall 2.

The bags are prepared to the extent where the left-hand side gusset 3 and the right-hand side gusset 4 have already been connected to the walls 1, 2 via the connecting weld seam 17 and are located in a flat state between the same. As an option, the bottom 5 may likewise have already been prepared. As seen in the direction of the side gussets 3, 4, the side gussets 3, 4 are of the same length as the walls 1, 2. The connecting weld seams 17 between the side gussets 3, 4 and the walls 1, 2 here extend over the entire length of the bag portion 13 up to the transition portion 14. The connecting weld seams 17 here are shorter than the side gussets 3, 4. This means that the side gussets 3, 4 are not connected to the walls 1, 2 in the transition portion 14 or in the head portion 6.

As an option, however, it is possible to provide an auxiliary weld seam 18 which connects the front wall 1 and the rear wall 2 together in a reference region 19, which is illustrated by dashed lines. The auxiliary weld seam 18 may also be in the form of a spot arranged in the comers of the reference region 19. In a first optional method step, a device severs this reference region 19 to provide a reference edge 20, along which the rest of the method steps can be executed. The reference edge 20 then forms the termination of the head portion 6.

Figure 4:
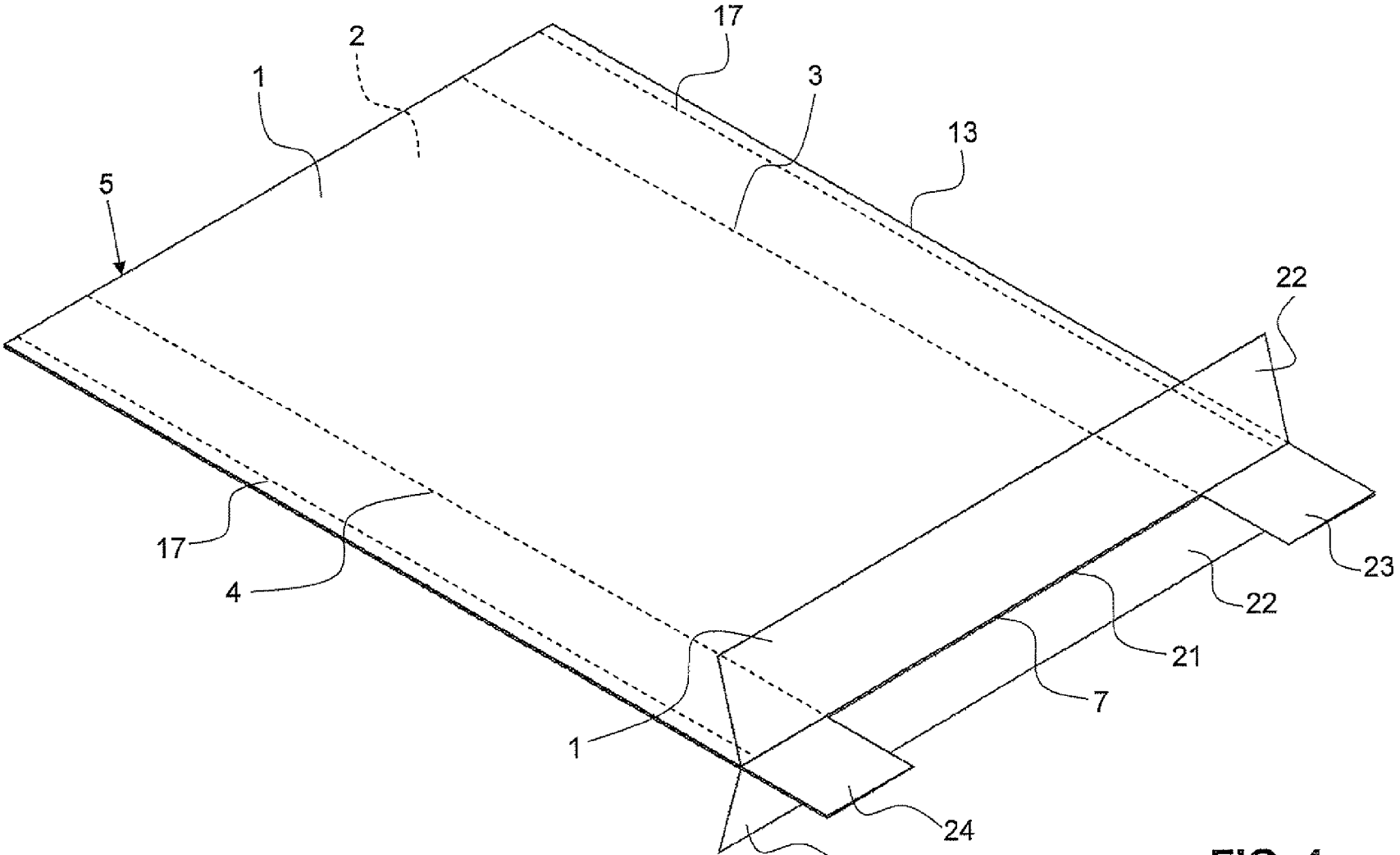

Following the optional step of removing the reference region 19, the front wall 1 and the rear wall 2 are pivoted at an angle relative to their respective surfaces. The upwardly pivoted parts of the walls 1, 2 may also be referred to as pivoting portions 22. This is illustrated in FIG. 4. The axis 21 about which the pivoting movement is executed is preferably a line in the region in which the bag portion 13 and the transition portion 14 meet. The pivoting operation means that parts of the side walls 3, 4 are free, that is to say are not covered by the walls 1, 2, and these parts of the side walls may be referred to as free ends 23, 24. In other words, it may also be said that the free ends 23, 24 project out of the interior of the bag.

Figure 5:
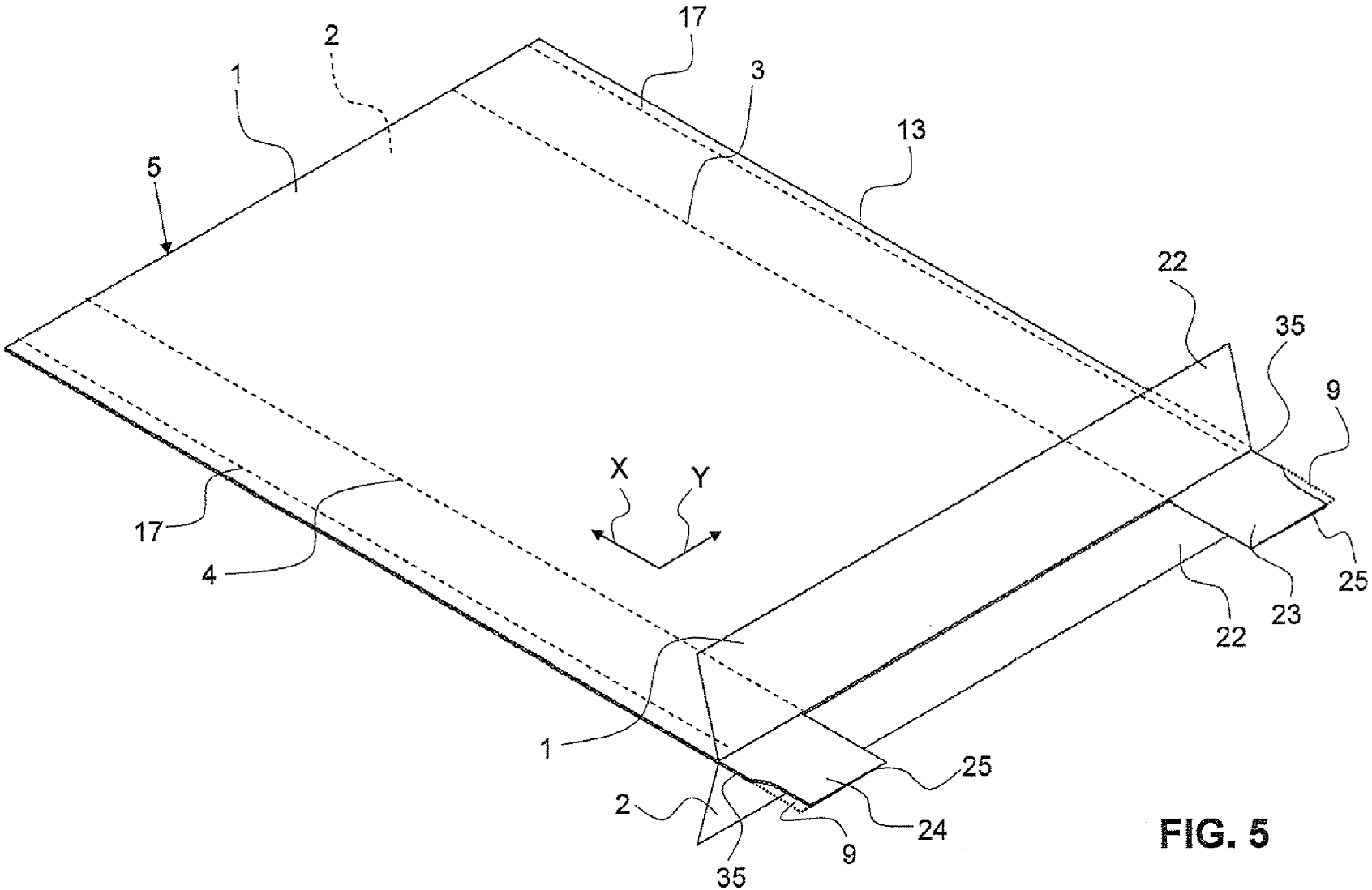

As is shown in FIG. 5, the free ends 23, 24 can be machined. In this embodiment, a respective cutoff region 9 is severed from each free end 23, 24. The cutoff region 9 is illustrated by dashed lines here and extends along the direction X, in which the corresponding side gusset 3, 4 runs, from the end side 25 of the side gusset 3, 4 into the free ends 23, 24 and is arranged transversely along the outer edge 35. The outer edge 35 here is the edge which is not directed towards the interior. The cutoff region 9 here extends both through the first portion 3*a*, 4*a* and through the second portion 3*b*, 4*b* of the side gussets 3, 4. The length of the cutoff region in the direction X is preferably greater than the width in the corresponding transverse direction Y. In the rear region, which is located opposite the end side 25, the cutoff region 9 is preferably rounded.

In a following step, the rear wall 2 is swung over again, and the corresponding pivoting portion 22 therefore runs parallel to the free ends 23, 24.

Figure 6:
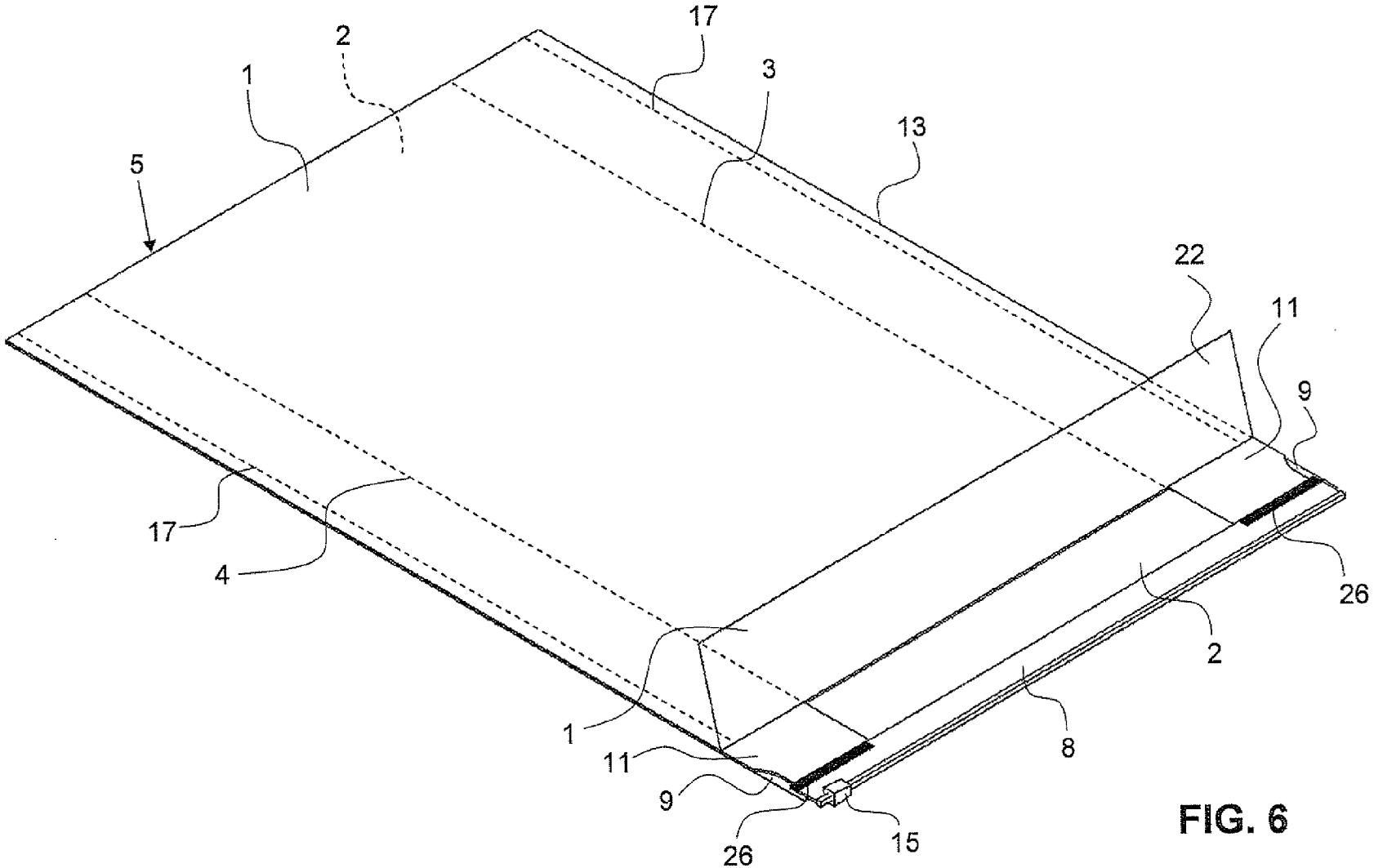
Figure 7:
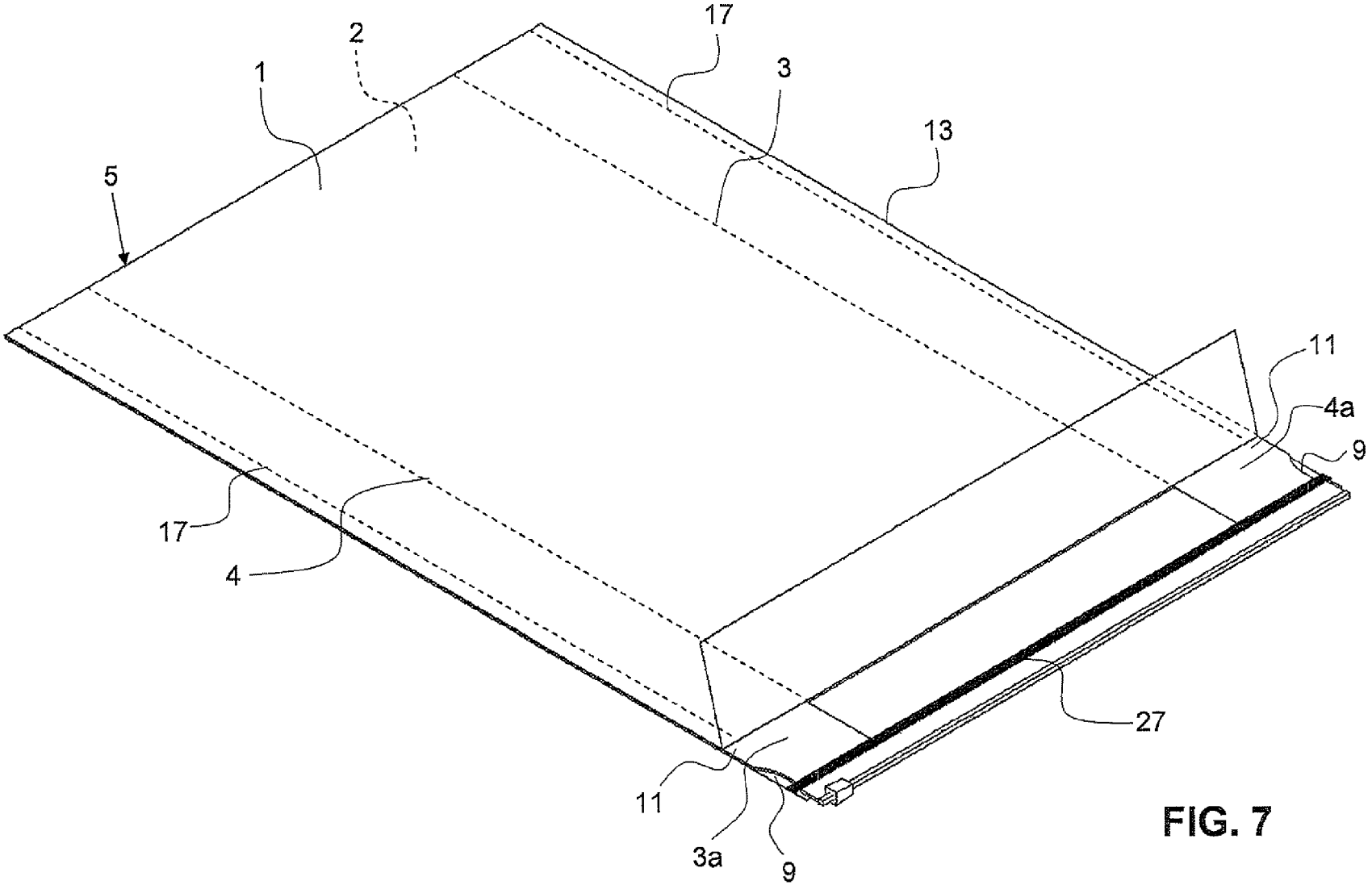

In a following step, the closure element 8 is then supplied. This is illustrated in FIG. 6. The closure element 8 is of a length which is preferably shorter than the width of the bag. That is to say, the closure element 8 extends only partially over the bag width. The length of the closure element 8 is particularly preferably selected such that the closure element projects into the cutoff regions 9 only to a partial extent, if at all. As shown in FIG. 5, the closure element 8 rests on the inside of the rear wall 2 and on the inside of the respective side gussets 3, 4. As mentioned above, the surfaces which are directed towards the inside are weldable. The welding here takes place in two stages. Initial welding 26 takes place in a first stage (FIG. 6). The closure element 8 is connected to the respective side gussets 3, 4 here, and the side gussets 3, 4 are connected to the rear wall 2. In a second stage (FIG. 7), the closure element 8 is welded to the rear wall 2 of the bag by way of a closure weld 27, which extends over the entire width of the bag and/or of the closure element 8. The two-stage procedure increases the reliability of the weld connection, in particular of the connection between the side gussets 3, 4 and the rear wall 2. This weld connection connects the side gussets 3, 4 and the closure element 8 to the rear wall 2 in a reliable and sealed manner. Furthermore, the closure element 8 is connected to the first portions 3*a*, 4*a* of the side gussets 3, 4 in a reliable and sealed manner.

Figure 8:
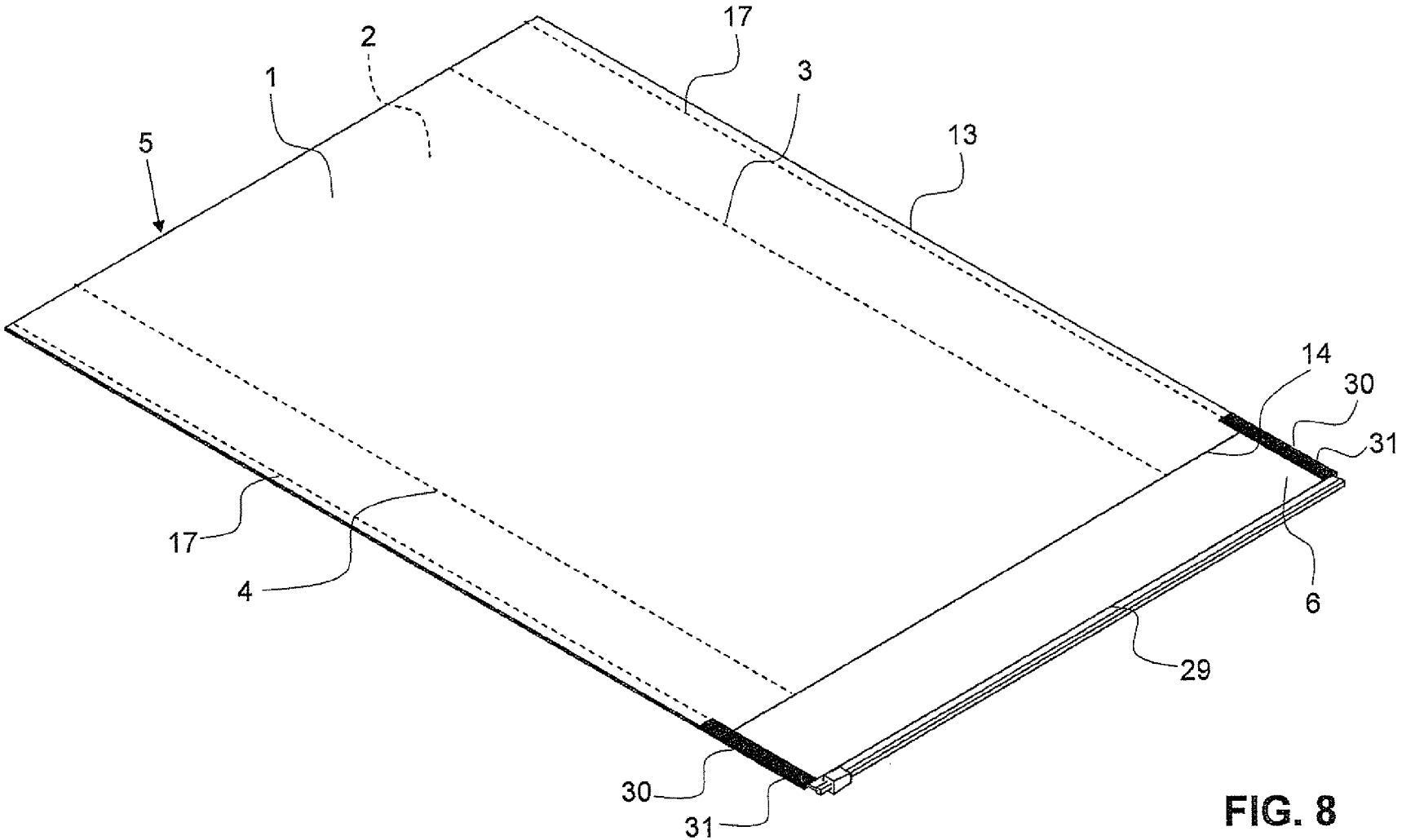
Figure 9:
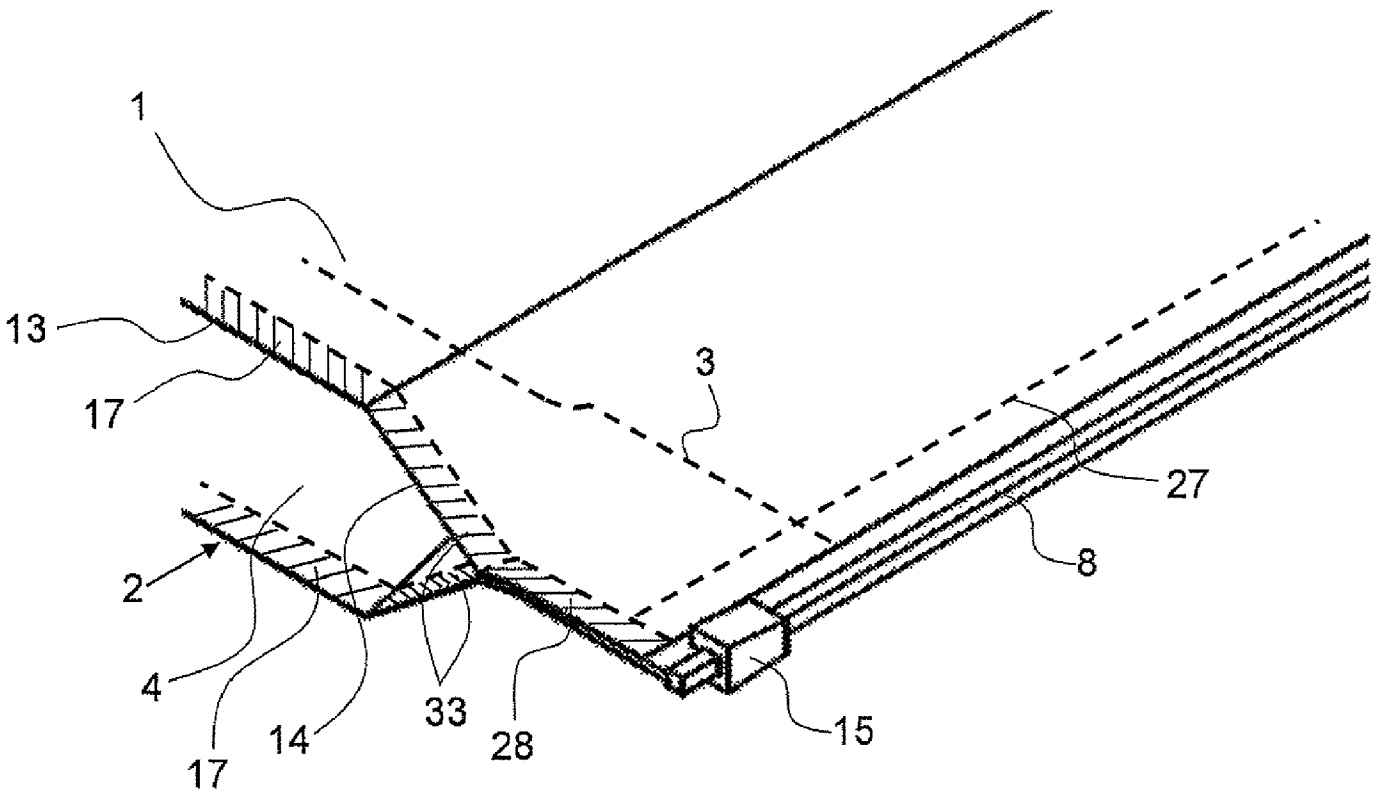
FIG. 9 shows a detail of the bag according to FIG. 1.

As soon as the closure element 8 has been welded on, the pivoting portion 22 of the front wall 1 can likewise be pivoted against the free ends 23, 24. The pivoting operation is followed by a further welding operation, which is illustrated in FIG. 8. The welding tool here extends from the head portion 6, via the transition portion 14, part of the way into the bag portion 13 and applies a lateral closure weld 31. The welding welds the weldable surface of the front wall 1 to the weldable surface of the rear wall 2 at the cutoff regions 9. This is illustrated in FIGS. 8 and 9, which shows a detail of a head region, as hatched surface 28, which may also be referred to as a closure weld 28. Welding the weldable surface of the front wall 1 to the weldable surface of the rear wall 2 in this head portion 6 prevents the bag from being able to gape in this region.

In addition, the weldable surface of the corresponding side gussets 3, 4 is connected to the front side 1 and rear side 2. This is illustrated in FIG. 9 by the hatched closure region 33. On account of the fact that the printed region B is not weldable, the side gussets 3, 4 are not welded to one another on the outside despite the action of heat, for which reason the side gussets 3, 4 can be opened out during the filling operation.

At this point in time, there is still no connection between the front wall 1 and the closure element 8, that is to say there is, between the front wall 1 and the closure element 8, a filling opening 29 through which the contents can be introduced into the bag. Otherwise, all other locations in the head region are welded appropriately. Following filling, the front wall 1 can be welded to the closure element 8.

In a further optional method step prior to filling, it is additionally possible to use a punching tool on the edge 30 in the region of the head portion. The punching tool here removes a fine strip from the bag in this region, in which case welding residues which have migrated outwards from the weld seam can be cut away. The result is then an aesthetically pleasing bag.

The welding is shown once again in FIG. 9. It can be seen here that the weld seam 17 merges into the closure region 33. The closure region 33 merges into the closure weld 28, which for its part merges into the closure weld 27.

FIGS. 10 to 14 show a further method of producing a bag. The outer structure of the bag is similar to the structure of the bag which has been explained above, for which reason reference is made, in this respect, to FIGS. 1 and 2 and the explanations relating to the same. Like parts are provided with like designations.

Figure 10:
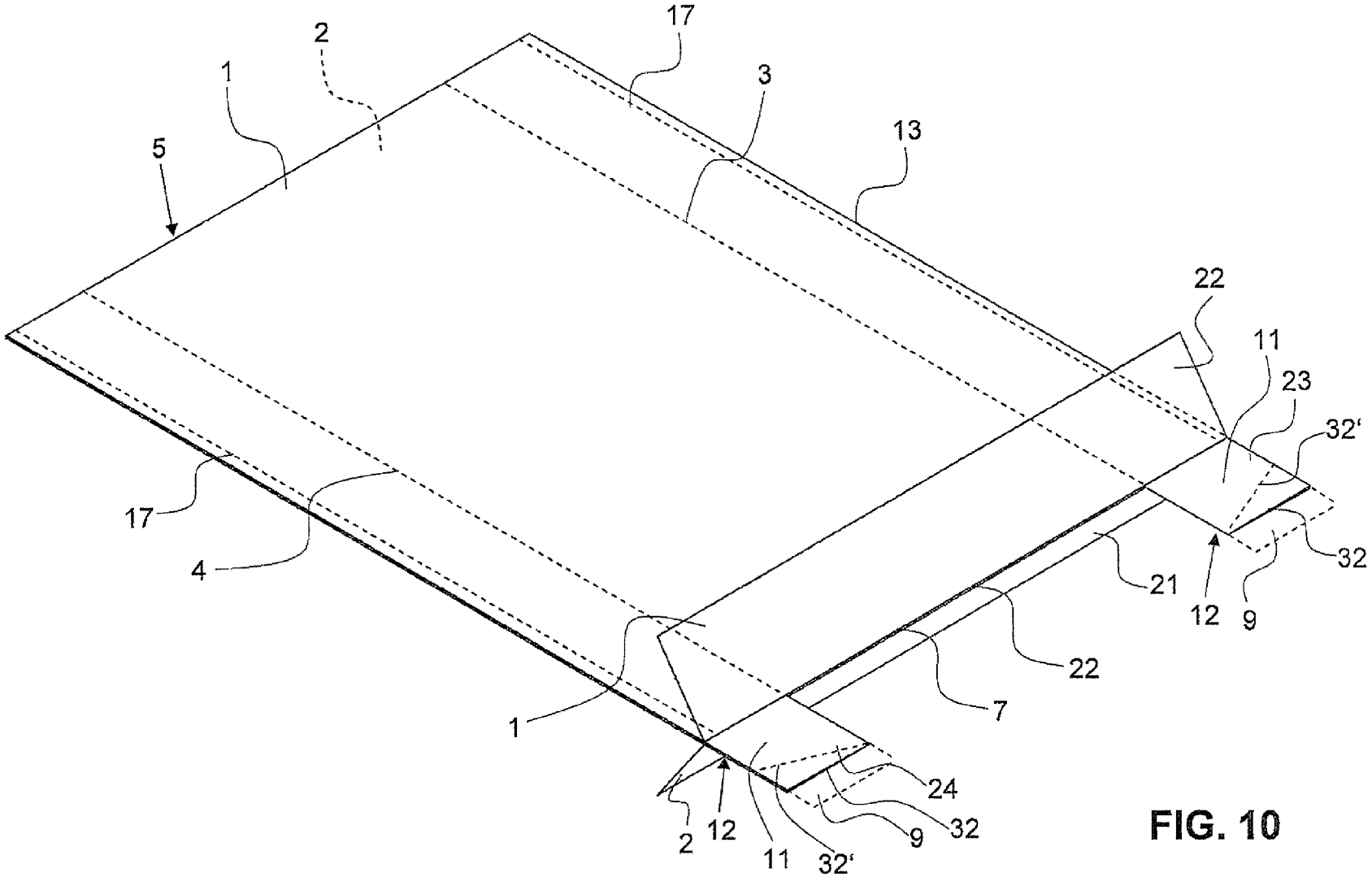
FIGS. 10 to 14 show a non-filled bag according to a second exemplary embodiment in different steps of is production.

FIG. 10 shows a first step of the production method. In this case, pivoting regions 22 of the front wall 1 and of the rear wall 2 are pivoted once again, about a pivot axis 21.

In a further step, once again, a respective cutoff region 9 is removed from the corresponding side gusset 3, 4. The cutoff region 9 here is in the form of a rectangle, the cutoff edge 32 running essentially perpendicularly to the running direction of the side gussets 3, 4. In other words, it may also be said that the side gussets 3, 4 are shorted.

As an alternative, it would also be possible for the cutoff edge 32 to extend at an angle to the running direction of the side gussets 3, 4. For example, it is conceivable for the angle to be arranged such that the length of the respective free end increases in the direction of the centre of the bag. This is indicated by the dashed line 32'.

Figure 11A:
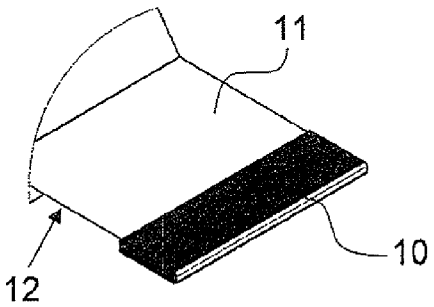
Figure 11B:
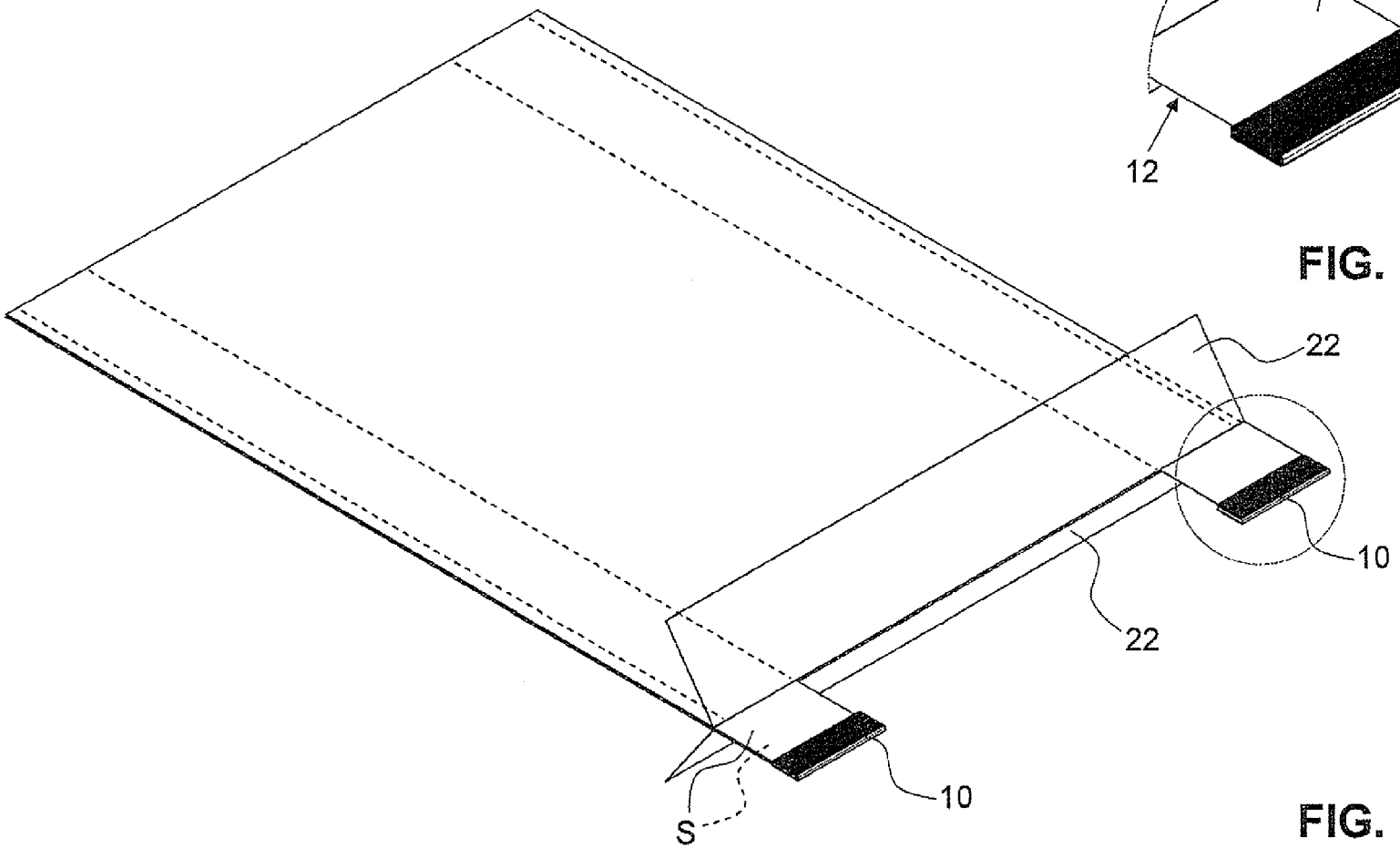

Once the cutoff region 9 has been removed, the bag, as is shown in FIGS. 11 and 11*a*, is supplied with an enveloping element 10. The enveloping element 10 is designed such that it envelops the respective side gussets 3, 4. This means that the enveloping element is in contact with the weldable surface S of the side gussets 3, 4, that is to say with the top side 11 of the side gusset and with the underside 12 of the side gusset. The folding of the side gussets 3, 4 means that the weldable surface S is directed both towards the front wall 1 and towards the rear wall 2. In other words, it may also be said that the enveloping element 10 envelops the front parts of the free ends 23, 24 in the region of the end side. The enveloping element 10 is then connected to the corresponding surface of the side gussets 3, 4 by a weld. The important factor is for the enveloping element 10 to be arranged such that it extends over the entire length of the cutoff edge 32 and envelopes the same entirely. The enveloping element 10 is formed, for example, from polyethylene or polypropylene and can be welded or sealed on both sides. For example, it is possible for the enveloping element 10 to be multilayered and to comprise a carrier layer. The important factor is for the enveloping element to be made of the same material as the weldable surface of the front wall 1 and of the rear wall 2, in which case it is possible to achieve a good and durable connection between the enveloping element and the front wall 1 and/or rear wall 2, as described herein.

In this exemplary embodiment, the enveloping element 10 is of the same width as the free ends 23, 24 of the side gussets 3, 4. In an alternative embodiment, it would also be possible to provide just one enveloping element 10, which extends over the entire width of the bag from the free end 23 to the free end 24. The only critical factor is for the free ends 23, 24 of the side gussets 3, 4 to be enveloped entirely by the respective enveloping element 10.

The operation of applying an enveloping element 10 connects that part of the side gusset 3, 4 which is directed towards the front wall 1 to that part of the side gusset 3, 4 which is directed towards the rear wall 2.

Figure 12:
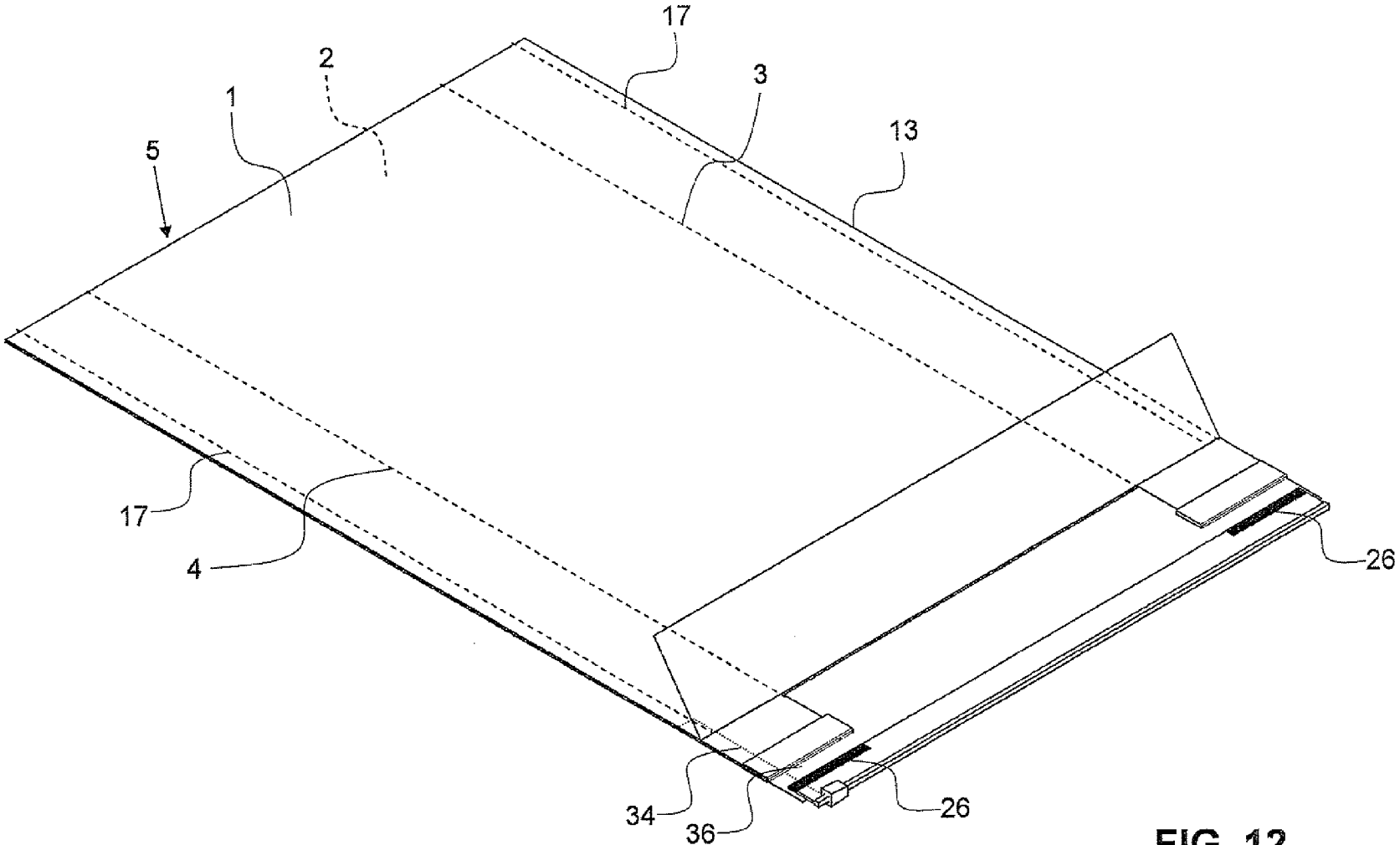

FIG. 12 shows that, in the further steps, the pivoting portion 22 of the rear wall 2 is then pivoted back into the original position. Furthermore, the closure element 8 is then placed in position and connected to the rear wall by way of an optional initial weld 26. The closure element 8 here is arranged such that there is an interspace 36 present between the closure element 8 and the enveloping element 10.

Figure 13:
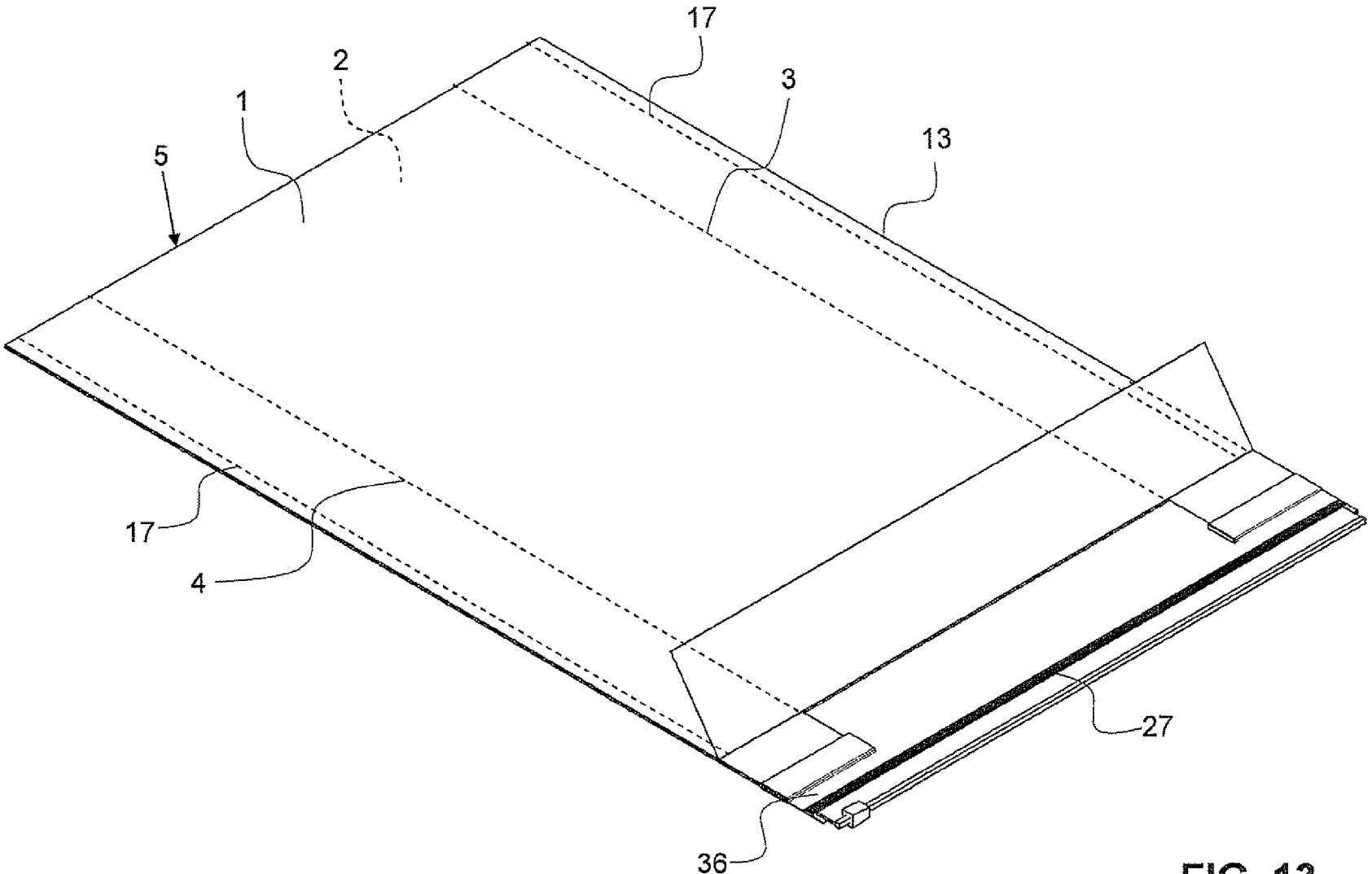

As in FIG. 13, the closure weld 27 is then made, this closure weld extending over the entire width.

Figure 14:
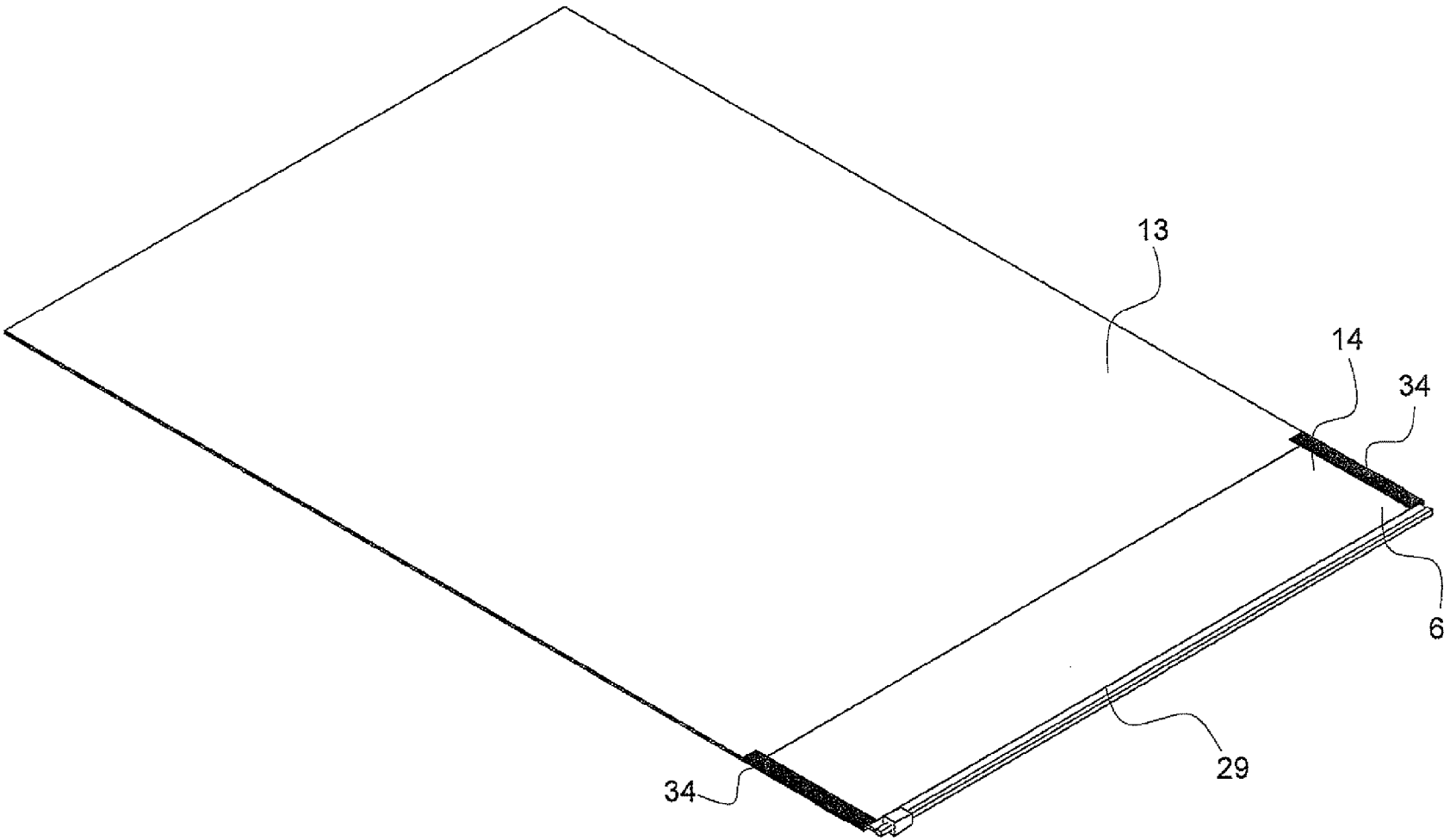

In a next step, as is illustrated in FIG. 14, the pivoting portion 22 of the front wall 1 is pivoted back into the original position. This is followed by further welding. The welding tool here extends from the head portion 6, via the transition portion 14, part of the way into the bag portion 13 and applies a lateral closure weld 34. The welding 34 welds the front wall 1 to the rear wall 2 partially indirectly and partially directly. Partially indirectly because the front wall 1 is connected to the side gusset 3, 4, the enveloping element 10 and the closure element 8 and because the rear wall 2 is connected to the same elements on the other side. In the region of the interspace 36, the front wall 1 is connected directly to the rear wall 2. The direct connection is a particularly good way of safeguarding against gaping.

In an alternative embodiment, in which the closure element 8 directly adjoins the enveloping element 10, the weld connection takes place indirectly, which also safeguards against gaping.

In FIG. 12, the region over which the lateral closure weld 34 extends is illustrated by dashed lines on the left-hand side. This welding makes it possible to prevent the bag from gaping in the front region. That is to say, the front wall 1 and the rear wall 2 always remain parallel to one another when the bag is closed, which prevents the closure element from rupturing accidentally.

As already mentioned in conjunction with the first exemplary embodiment, there is still no connection between the front wall 1 and the closure element 8, that is to say, between the front wall 1 and the closure element 8, there is a filling opening 29 through which the contents can be introduced into the bag. Otherwise, all the open locations of the bag have been welded appropriately.

Figure 15:
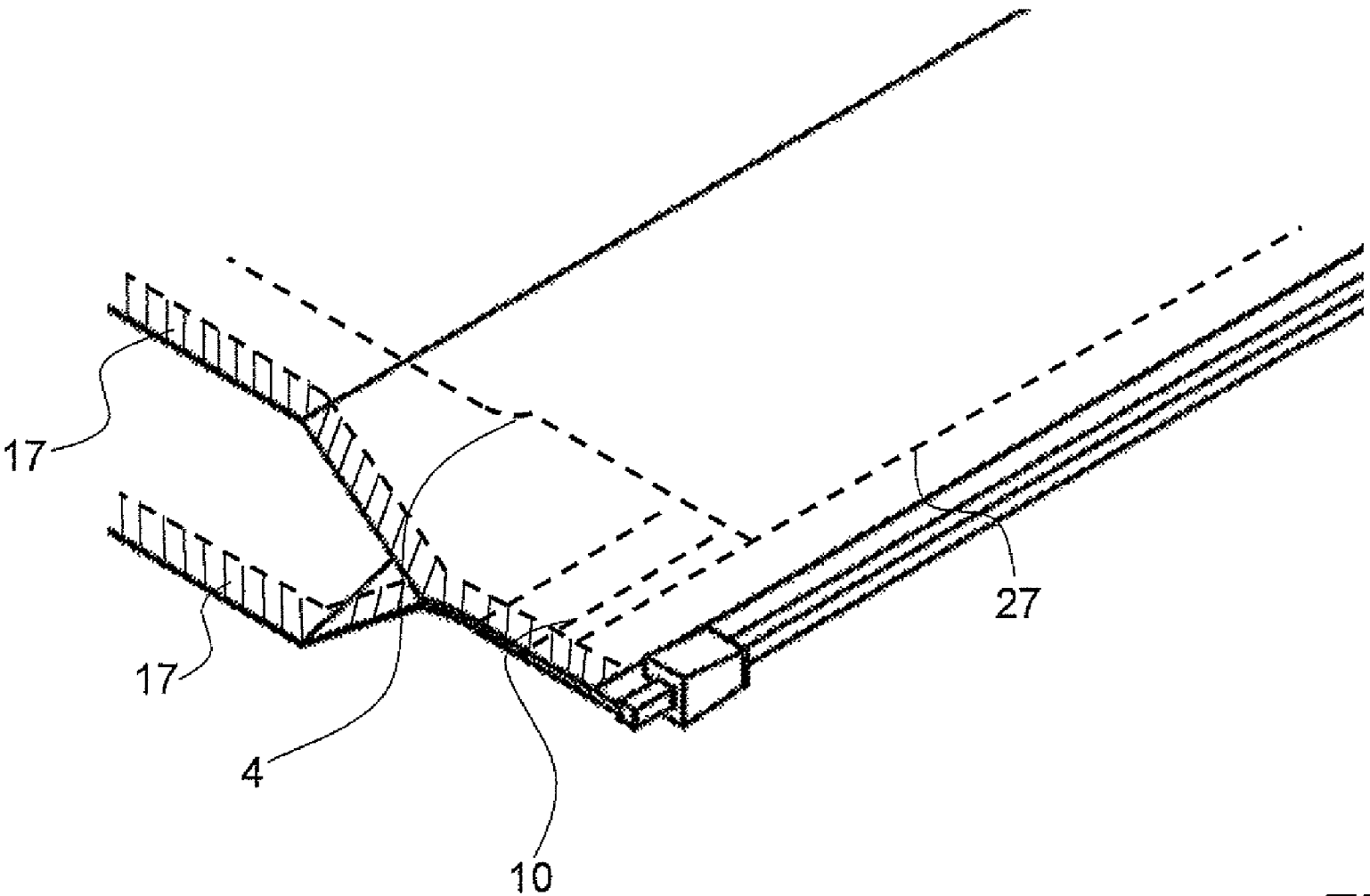
FIG. 15 shows a detail of a filled bag according to FIG. 10.

The welding is shown once again in FIG. 15. It can be seen here that the weld seam 17 merges, in the region of the enveloping element 10, into the closure weld 34, which for its part merges into the closure weld 27.

As mentioned above, it is also possible here for the edge 30 to be tidied up by way of a further punching operation.

| List of Designations | |
|---|---|
| 1 | Front wall |
| 2 | Rear wall |
| 3 | Right-hand side gusset |
| 4 | Left-hand side gusset |
| 5 | Bottom |
| 6 | Head portion |
| 7 | Opening |
| 8 | Closure element |
| 9 | Cutoff regions |
| 10 | Enveloping element |
| 11 | Top side of the side gusset |
| 12 | Underside of the side gusset |
| 13 | Bag portion |
| 14 | Transition portion |
| 15 | Slider |
| 16 | Gaping region |
| 17 | Weld seam |
| 18 | Auxiliary weld seam |
| 19 | Reference region |
| 20 | Reference edge |
| 21 | Pivot axis |
| 22 | Pivoting portions |
| 23 | Free end |
| 24 | Free end |
| 25 | End side |
| 26 | Auxiliary weld |
| 27 | Closure weld |
| 28 | Closure weld |
| 29 | Filling opening |
| 30 | Edge |
| 31 | Lateral closure weld |
| 32 | Cutoff edge |

-continued

| List of Designations | |
|---|---|
| 33 | Closure region |
| 34 | Closure weld |
| 35 | Outer edge |
| 36 | Interspace |

The invention claimed is:

1. A method of producing a packaging bag from a multi-layered sheet material which can be welded on one side, the method comprising the steps of:

providing a front wall, a rear wall, a right-hand side gusset and a left-hand side gusset, and a closure element;

welding the two side gussets, the front wall and the rear wall having essentially the same length to one another, wherein the side gussets are connected to the front wall and the rear wall over their entire length but not in the head portion, and wherein the weldable surface is directed towards the interior of the packaging bag;

swinging the front wall or the rear wall or both away from the surface of the respective wall;

cutting off and removing the cutoff regions of the side gussets; and removing said cutoff regions and following the removal of the cutoff regions, pivoting the rear wall into the original position;

placing the closure element in position, and welding to the rear wall and the side gusset;

pivoting the front wall into the original position and executing a welding operation in order to connect the front wall and the rear wall partially to one another thereby forming a head portion and bottom portion of the bag, said head portion located opposite the bottom and having an opening which can be closed by the closure element wherein said head portion is part of the front wall and the rear wall.

2. The method according to claim 1, wherein the cutoff region extends from an end side, in the direction of the respective side gusset, along the outer edge of the side gusset.

3. The method according to claim 1, wherein the length of the cutoff region in the direction of the side gusset is greater than the width of the cutoff region in the direction running transversely to the direction of the side gusset.

4. The method according to claim 1, wherein the weld connection between the front wall and the rear wall is formed directly in the cutoff region and is formed indirectly, via the respective side gusset and the closure element, in the remaining regions.

5. The method according to claim 1, wherein the cutoff region runs transversely, or at an angle, to the direction of the respective side gusset and extends over the entire width of the respective side gusset, in which case the side gusset is shortened in length and a cutoff edge is produced.

6. The method according to claim 5, wherein, following the cutting operation, an enveloping element is connected to the side gusset, wherein the enveloping element encloses the cutoff edge of the cutoff region, and wherein the enveloping element is welded to the side gusset on the top side of the side gusset and on the underside of the side gusset.

7. The method according to claim 1, wherein the weld connection between the front wall and the rear wall is formed indirectly via the respective side gusset and the closure element and the enveloping element or directly in the region of an interspace or both.

8. The method according to claim 1, wherein the closure element has a length which is smaller than the width of the bag, and in that the closure element is arranged centrally in relation to the width.

9. The method according to claim 1, wherein following the welding operations, parts are cut away from the cutoff regions, in which case the edges of the bag in these regions are cleared of residues remaining from the welding operation.

10. The method according to claim 1, wherein prior to the removal of the cutoff regions, a reference region is severed, and this provides a reference edge, the reference region adjoining the region of the opening or the head portion or both.

* * * * *